US008602322B2

(12) United States Patent
Ogawa

(10) Patent No.: US 8,602,322 B2
(45) Date of Patent: Dec. 10, 2013

(54) FUEL INJECTION VALVE OF ACCUMULATOR INJECTION SYSTEM

(75) Inventor: Hisao Ogawa, Kanagawa (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 787 days.

(21) Appl. No.: 12/673,356

(22) PCT Filed: Sep. 25, 2008

(86) PCT No.: PCT/JP2008/067868

§ 371 (c)(1),
(2), (4) Date: Mar. 17, 2010

(87) PCT Pub. No.: WO2009/072346

PCT Pub. Date: Jun. 11, 2009

(65) Prior Publication Data

US 2010/0200677 A1 Aug. 12, 2010

(30) Foreign Application Priority Data

Dec. 5, 2007 (JP) ..... 2007-315269

(51) Int. Cl.
*F02M 41/16* (2006.01)

(52) U.S. Cl.
USPC ..... 239/96; 239/88; 239/124; 239/533.3; 239/584

(58) Field of Classification Search
USPC ..... 239/88, 96, 124, 127, 533.2–533.4, 239/584, 585.1
See application file for complete search history.

(56) References Cited

U.S. PATENT DOCUMENTS 5,438,968 A * 8/1995 Johnson et al. ..... 239/96
5,664,545 A * 9/1997 Kato et al. ..... 123/496
5,732,679 A 3/1998 Takahasi et al.

(Continued)

FOREIGN PATENT DOCUMENTS

DE 198 26 795 12/1999
EP 1 314 881 5/2003

(Continued)

OTHER PUBLICATIONS

Japanese Office Action issued Nov. 28, 2011 in corresponding Japanese Patent Application No. 2007-315269 with English translation.

(Continued)

*Primary Examiner* — Steven J Ganey
(74) *Attorney, Agent, or Firm* — Wenderoth, Lind & Ponack, L.L.P.

(57) ABSTRACT

Providing a fuel injection valve of the accumulator injection system, whereby the surge pressure caused by the change of the fuel injection rate when the nozzle needle begin to be seated on is reduced or lessened; the deterioration as to the fuel injection performance and the strength of the injection valve components the deterioration which is caused by the surge pressures is prevented. A fuel injection valve of the accumulator injection system, the fuel injection valve including: a nozzle 1, a nozzle needle 2, and a control rod 23; wherein, the control rod is provided with a groove whereby the groove communicates the high pressure fuel passage prior to a fuel injection shot; the groove is disconnected to the high pressure fuel passage and the fuel is injected into an engine combustion chamber during the fuel injection shot; the groove communicates with the high pressure fuel passage at the end of the injection shot.

3 Claims, 6 Drawing Sheets

(56) References Cited

U.S. PATENT DOCUMENTS

| | | | | |
|---|---|---|---|---|
| 5,775,301 | A * | 7/1998 | Ganser | 123/467 |
| 6,499,467 | B1 | 12/2002 | Morris et al. | |
| 2003/0111548 | A1 | 6/2003 | Buck | |
| 2005/0173564 | A1 | 8/2005 | Cooke | |

FOREIGN PATENT DOCUMENTS

| | | |
|---|---|---|
| JP | 60-75680 | 5/1985 |
| JP | 2-12057 | 1/1990 |
| JP | 2-248646 | 10/1990 |
| JP | 7-238877 | 9/1995 |
| JP | 8-277762 | 10/1996 |
| JP | 8-296520 | 11/1996 |
| JP | 9-14077 | 1/1997 |
| JP | 2000-027734 | 1/2000 |
| JP | 2003-519336 | 6/2003 |
| JP | 2003-184705 | 7/2003 |
| JP | 2003-529718 | 10/2003 |
| JP | 2005-201271 | 7/2005 |

OTHER PUBLICATIONS

Supplementary European Search Report dated Mar. 8, 2011 in corresponding European Patent Application No. 08856234.3.

International Preliminary Report on Patentability and Written Opinion of the International Searching Authority mailed Aug. 19, 2010 in International (PCT) Application No. PCT/JP2008/067868.

International Search Report issued Jan. 6, 2009 in International (PCT) Application No. PCT/JP2008/067868.

Japanese Office Action issued Mar. 29, 2012 in corresponding Japanese Patent Application No. 2007-315269 with English translation.

Decision to grant a European Patent issued Oct. 25, 2012 in corresponding European Patent Application No. 08856234.3.

Japanese Notice of Allowance, with English translation, issued Jun. 22, 2012 in corresponding Japanese Patent Application No. 2007-315269.

* cited by examiner 9
13
14b
18
P
12
20
24
23a
23c
22
23b
23
14a
5
2
1
4
4a

Needle valve lift
t

Fuel (line) pressure
S
B
t

Fuel injection rate
t

FUEL INJECTION VALVE OF ACCUMULATOR INJECTION SYSTEM

BACKGROUND OF THE INVENTION

1. Field of the Invention

The present invention relates to a fuel injection valve and a means for reducing the surge pressure occurrence or propagation in the fuel injection valve of the accumulator injection system (a common-rail injection system), the fuel injection valve injecting the high pressure fuel supplied from a pressurized fuel accumulator, into an engine combustion chamber, through at least one nozzle hole provided in a nozzle of the valve.

2. Background of the Invention

FIG. 5 shows an outline cross-section as to an example of a fuel injection valve of the accumulator injection system (a common-rail injection system). As shown in FIG. 5, the fuel injection valve 100 comprises: a nozzle 1 that is provided with at least one nozzle hole 4 which are placed at the tip part of the nozzle, thereby fuel is injected through the nozzle hole, and a nozzle needle (valve) 2 is fitted into the inner cylindrical space of the nozzle 1 so that the nozzle needle 2 slides in the inner cylindrical space with reciprocating movements; a spacer 6; and, a (fuel injection valve) body 7 to which the nozzle 1 and the spacer 6 are tightly attached by a nozzle holder 17, for example, by the screw mechanism of the nozzle holder.

While the nozzle needle 2 is being pressed on a valve seat 5*a* of the nozzle 1, the fuel injection valve is kept under a closed condition. The nozzle needle 2 is annexed to a needle spring shoe 8*a* above the nozzle needle 2 and a push rod 8*b* that is placed above the a needle spring shoe 8*a* and fitted into the inner cylindrical space of the fuel injection valve body 7 so that the push rod slides in the inner cylindrical space with reciprocating movements. The numeral 9 denotes a needle spring that presses the nozzle needle 2 against the valve seat 5*a*, namely, the needle spring determines the opening pressure of the nozzle needle valve.

The numeral 11 denotes a fuel inlet piece in which a fuel inlet passage 12 is formed. The fuel inlet passage 12 communicates with a fuel passage 14*a* and a fuel passage 14*b* that are formed in the fuel injection valve body 7, thereby the fuel passage 14*a* communicates with a fuel sump 5 that is a space filled with fuel in the nozzle and surrounds the nozzle needle 2.

On the other hand, the fuel passage 14*b* communicates with a backward space of the push rod 8*b*, namely, a space above the push rod 8*b* via an orifice 13; thus, with a fuel pressure in the backward space, the push rod 8*b*, the needle spring shoe 8*a* and the nozzle needle can be thrust downward toward the valve seat (in the case where the needle valve is closed).

The numeral 14 denotes a solenoid that actuates a pilot needle valve locating at an upper side of the fuel injection valve; when the pilot needle valve is closed, the pressure in the space above the push rod holds so that the nozzle needle 2 is closed; on the other hand, when the pilot needle valve is opened, the pressure in the space above the push rod is released so that the nozzle needle 2 is opened. Thus, the fuel injection timing is controlled. In addition, the numeral 24 denotes a fuel drain passage.

In the fuel injection valve 100 as described above, when the solenoid 14 activates the pilot needle valve, a passage 10 is opened; at the same time, the fuel from the fuel inlet passage 12 is supplied toward the fuel sump 5 through the fuel passage 14*a*; then, the fuel pressure force acts on the nozzle needle 2 from the lower side thereof; thus, the nozzle needle comes apart from the valve seat 5*a*, and the fuel is injected into the combustion chamber through the nozzle hole 4.

Further, the patent reference 1 (JP2000-27734) discloses an example as to the fuel injection valve of the accumulator injection system, whereby the steep rising of the fuel injection rate is restrained so as to reduce the nitrogen oxide generation (NOx generation).

FIGS. 6, 6(A), 6(B) and 6(C) explain the state of the fuel injection as to the fuel injection valve 100 of the accumulator injection system (i.e. a common-rail injection system) as depicted in FIG. 5.

In FIG. 6, when the fuel injection valve 100 of the accumulator injection system (i.e. the common-rail injection system) is about to stop an injection shot, a high pressure fuel injection rate (see FIG. 6(C)) is maintained until the moment before the injection shot is completed in order to inject the highly pressurized fuel that is accumulated in the common-rail; under such a condition, the nozzle needle 2 is going to sit on the valve seat 5*a* so that the fuel injection valve closes. In this connection, FIG. 4(A) depicts the change as to the lift of the nozzle needle 2.

As explained above, the change of the fuel injection rate during the nozzle needle closing is so great that a high surge pressure S is caused in the high-pressure fuel lines (such as a high-pressure line 19, the fuel passage 14*a* and the fuel passage 14*b*) as depicted in FIG. 4(B).

The larger the capacity of the fuel injection valve, the more remarkable the surge pressure S. When the level of the surge pressure S exceeds an allowable limit, the fuel injection performance is spoiled and the strength of the components of the injection valves is impaired.

SUMMARY OF THE INVENTION

In view of the above-stated conventional technologies and anticipated solutions thereof, the present disclosure aims at providing a fuel injection valve of the accumulator injection system, whereby the surge pressure caused by the change of the fuel injection rate when the nozzle needle valve is going to close is reduced; the deterioration as to the fuel injection performance and the strength of the injection valve components the deterioration which is caused by the surge pressures is restrained.

In order to achieve the above objective, the present invention discloses a fuel injection valve of the accumulator injection system, the fuel injection valve comprising:

a nozzle in which at least one nozzle is formed;

a nozzle needle which is fitted into the inner cylindrical space of the nozzle so that the nozzle needle slides in the inner cylindrical space with reciprocating movements;

thereby, the high pressure fuel accumulated in a highly pressurized fuel accumulator is injected into the combustion chamber through a high pressure fuel passage from the highly pressurized fuel accumulator and the nozzle hole, in response to the lift of the nozzle needle from the valve seat in the nozzle, the fuel injection valve further comprising a control rod that is annexed to the nozzle needle at the upper side of the nozzle needle, wherein the control rod is provided with a groove whereby the groove communicates the high pressure fuel passage prior to a fuel injection shot; the groove is disconnected to the high pressure fuel passage and the fuel is injected into an engine combustion chamber during the fuel injection shot; the groove communicates with the high pressure fuel passage at the end of the injection shot.

A concrete example according to the above-described invention is the fuel injection valve of the accumulator injection system, the high pressure fuel passage comprising:

a first port through which the high pressure fuel and the pressure thereof act on the nozzle needle upward so as to open the nozzle needle valve;

a second port through which the high pressure fuel and the pressure thereof act on the control rod and the nozzle needle downward so as to close the nozzle needle valve;

a control port through which the high pressure fuel and the pressure thereof act on the control rod and the groove thereof so as to release the high pressure of the fuel in response to the lift of the nozzle needle or the fuel injection timing.

A preferable example according to the above-described invention is the fuel injection valve of the accumulator injection system; whereby, in the case where the fuel injection process proceeds to the injection finish, the fuel injection valve is configured so that the groove communicates with the fuel inlet passage after the groove has communicated with a fuel drain line and the pressure in the groove has been sufficiently reduced (to the drain line pressure level).

In the fuel injection valve of the accumulator injection system according to the above invention and the example thereof, the fuel injection valve comprising:

a nozzle in which at least one nozzle is formed;

a nozzle needle which is fitted into the inner cylindrical space of the nozzle so that the nozzle needle slides in the inner cylindrical space with reciprocating movements;

thereby, the high pressure fuel accumulated in a highly pressurized fuel accumulator is injected into the combustion chamber through a high pressure fuel passage from the highly pressurized fuel accumulator and the nozzle hole, in response to the lift of the nozzle needle from the needle seat in the nozzle, the fuel injection valve further comprising a control rod that is annexed to the nozzle needle at the upper side of the nozzle needle, wherein the control rod is provided with a groove whereby the groove communicates the high pressure fuel passage prior to a fuel injection shot; the groove is disconnected to the high pressure fuel passage and the fuel is injected into an engine combustion chamber during the fuel injection shot; the groove communicates with the high pressure fuel passage at the end of the injection shot; thereby, the high pressure fuel passage comprising:

a first port through which the high pressure fuel and the pressure thereof act on the nozzle needle upward so as to open the nozzle needle valve;

a second port through which the high pressure fuel and the pressure thereof act on the control rod and the nozzle needle downward so as to close the nozzle needle valve;

a control port through which the high pressure fuel and the pressure thereof act on the control rod and the groove thereof so as to release the high pressure of the fuel in response to the lift of the nozzle needle or the fuel injection timing;

consequently, the groove is disconnected to the high pressure fuel passage during the fuel injection shot; preferably, before the groove is disconnected to the high pressure fuel passage, the groove communicates with the fuel drain line so as to release a part of the fuel in the groove and a part of the high pressure thereof toward the fuel drain line so that the pressure in the groove is sufficiently reduced by the release; then, the groove is disconnect to the high pressure fuel so that the fuel is injected into the combustion chamber of the engine through the nozzle hole.

According the configuration described above, when the nozzle needle is fully lifted up, the fuel pressure in the groove is sufficiently reduced; subsequently, when the fuel injection shot is about to finish, the nozzle needle valve is going to close under a condition that the groove is filled with the fuel of a sufficiently reduced pressure.

The surge pressure is generated, when the nozzle needle comes closer to the valve seat so as to sit thereon; at the same time, the port (the control port), namely, the fuel inlet passage communicates with the groove opens; thus, a part of the fuel flows into the groove, or a part of the high fuel pressure in the fuel inlet passage is released toward the groove; therefore, the surge pressure in closing the nozzle needle valve is restrained (reduced).

Accordingly, the deterioration as to the fuel injection performance or the strength of the injection valve components is prevented. The larger the capacity of the fuel injection valve that is installed in an engine (The larger the capacity of the engine that is provided the fuel injection valve), the more remarkable the surge pressure reduction.

Further, according to the present invention, in the case where the fuel injection process proceeds to the injection finish, the fuel injection valve is configured so that the groove communicates with the fuel inlet passage after the groove has communicated with the fuel drain line and the pressure in the groove has been sufficiently reduced toward the fuel drain line pressure level; hence, before the communication between the groove and the fuel inlet passage is shut and the fuel injection starts, the groove communicates with the fuel drain line and the pressure in the groove has been released; therefore, in closing the nozzle needle valve, the port that connects the groove to the fuel inlet passage is smoothly opened (e.g. without a backward flow) under an condition that the pressure in the groove is kept at a sufficiently reduced level. Accordingly, the effect as to the surge pressure attenuation can be enhanced.

DETAILED DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

As briefed above, FIGS. 1 to 4(C) explain the four conditions (the first to the fourth) as to the fuel injection valve of the accumulator injection system (a common-rail injection system) according to the embodiment (the first embodiment) of the present invention.

Figure 1:
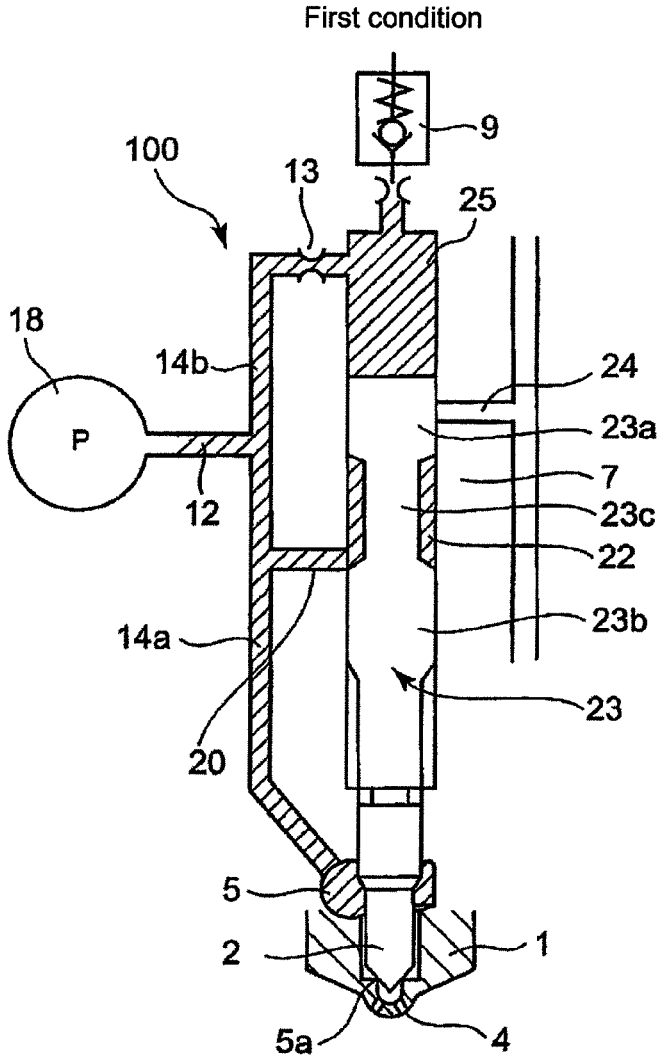
FIG. 1 explains a first condition as to a fuel injection valve of the accumulator injection system (a common-rail injection system) according to an embodiment of the present invention, whereby, the first condition means a stage in which the fuel injection valve has closed and is going to start a fuel shot.

As shown in FIG. 1, an fuel injection valve 100 is provided with:

a nozzle 1 that is provided with at least one nozzle hole 4 which are placed at the tip part of the nozzle, thereby fuel is injected through the nozzle hole, a nozzle needle 2 that is fitted into the inner cylindrical space of the nozzle 1 so that the nozzle needle 2 slides in the inner cylindrical space with reciprocating movements; and a (fuel injection valve) body 7.

While the nozzle needle 2 is being pressed on a valve seat 5*a* of the nozzle 1, the fuel injection valve or the needle valve 2 is held under closed conditions. The nozzle needle 2 is annexed to a control rod 23 via a needle spring shoe 8*a*; the control rod 23 is fitted into an inner cylindrical space of the fuel injection valve body 7 so that the control rod 23 slides in the inner cylindrical space with reciprocating movements; further, the control rod 23 is provided with a small outer diameter part 23*c* with which a groove 22 (a groove with a shape of a circular tube) around the outer periphery of the part 23 having a width along the rod axis direction is formed.

The numeral 18 denotes a pressurized fuel accumulator to which a fuel inlet passage 12 is communicated. The fuel inlet passage 12 communicates with a fuel passage 14*a* and a fuel passage 14*b*. Further, the fuel passage 14*a* communicates with a fuel sump 5 that is a space filled with fuel in the nozzle and surrounds the nozzle needle 2. In addition, the numeral 24 denotes a fuel drain passage.

On the other hand, the fuel passage 14*b* communicates with a backward space of the push rod 8*b*, namely, a space above a control rod 23 via the orifice 13; thus, with a fuel pressure, control rod 23, the needle spring shoe 8*a* and the nozzle needle can be thrust downward toward the valve seat. In addition, the fuel injection valve is provided with a solenoid for operating the fuel injection valve, namely, the nozzle needle 2; the nozzle needle valve 2 is operated so as to close or open, through the movements of the pilot needle valve that is operated by the solenoid.

A fuel inlet passage 20 (toward a control port) is branched from the fuel passages 14*a* and 14*b*. On the other hand, the control rod 23 is provided with a small outer diameter part 23*c* with which a groove 22 around the outer periphery of the part 23 having the width along the rod axis direction is formed.

Hence, a high-pressure fuel line 12 from the pressurized fuel accumulator 18 communicates with: the fuel passage 14*a* (the first port for the control rod) through which the fuel flows toward the valve seat 5*a* (the nozzle needle seat) of the nozzle 1, and thrusts the nozzle needle upward so as to open the nozzle needle valve 2; the fuel passage 14*b* (the second port for the control rod) through which the fuel flows toward the upper space over the control rod via the pressure throttle (the orifice) 13, thrusts the control rod downward so as to close the nozzle needle valve 2; and, the fuel inlet passage 20 (the control port for the control rod) through which the fuel flows into the groove 22 so as to control the movement of the control rod or the fuel injection timing (the valve close delicate timing).

Figure 5:
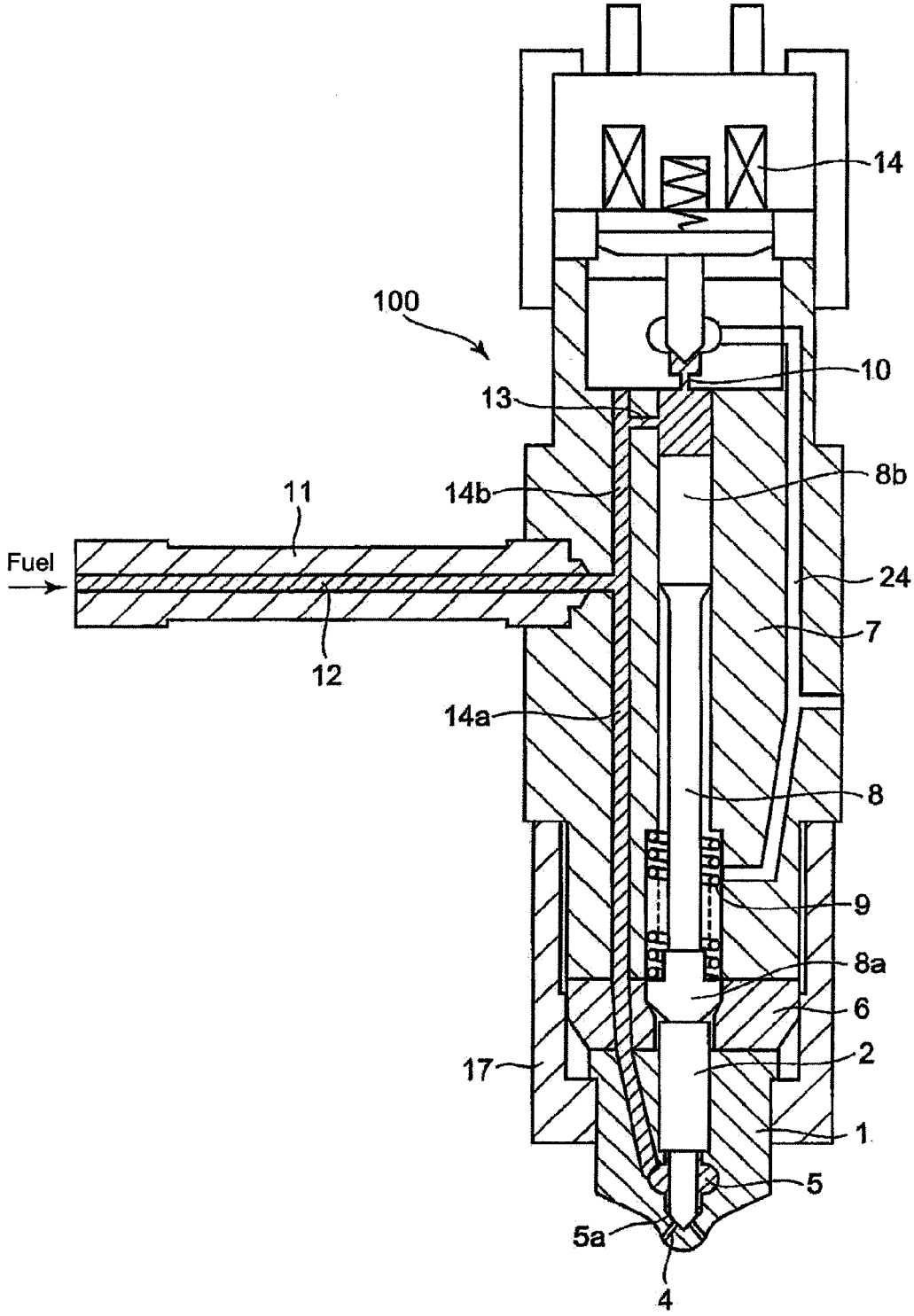
FIG. 5 shows an outline cross-section as to an example of the fuel injection valve of the accumulator injection system (a common-rail injection system)
Figure 6:
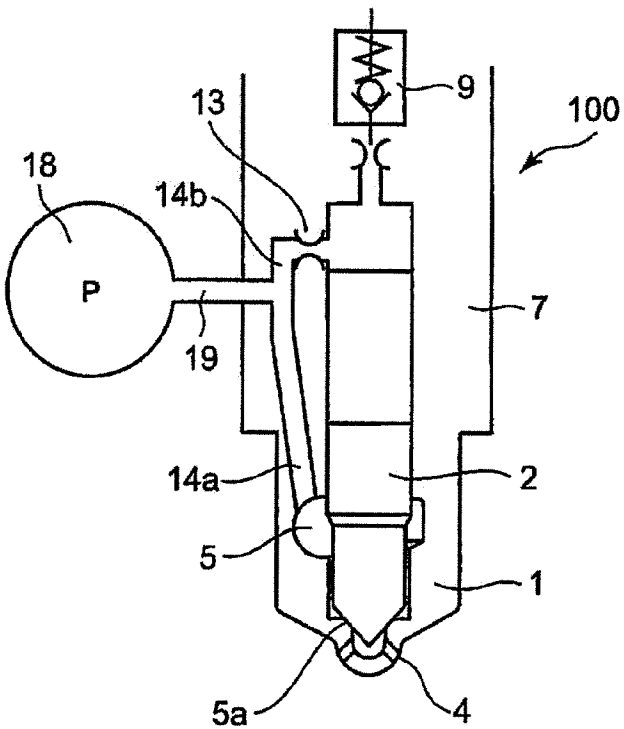
FIGS. 6, 6(A), 6(B) and 6(C) explain the injection conditions the fuel injection valve of the accumulator injection system (a common-rail injection system) as depicted in FIG. 5.
Figure 6A:
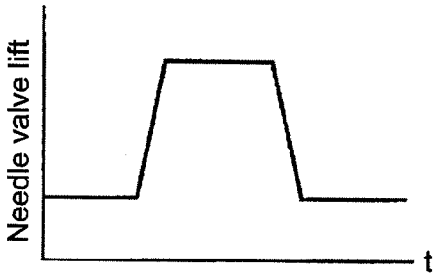
Figure 6B:
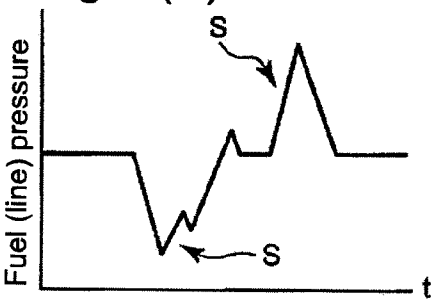
Figure 6C:
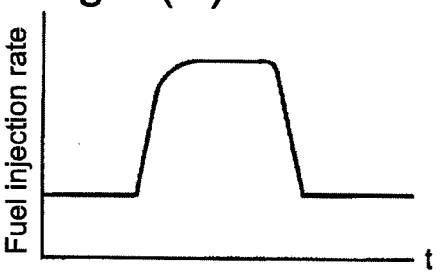

The other configuration that is not described in the above explanation in relation to FIGS. 1 to 4 (i.e. 1, 1(A), . . . , 4, 4(A), . . . , 4(C)) is the same as the configuration described in relation to FIG. 5.

As shown in FIG. 1, in the first stage before the fuel injection starts, the fuel inlet passage 20 communicates with the groove 22, namely, the space around the small outer diameter part 23*c* of the control rod 23; and the groove 22 is filled with the high pressure fuel; the nozzle needle 2 is seated on the valve seat 5*a* and the sealing between the nozzle needle 2 and the valve seat 5*a* is kept. Further, in this stage, the fuel drain line 24 (the drain port) is blocked by a first outer diameter part 23*a* of the control rod 23.

Figure 2:
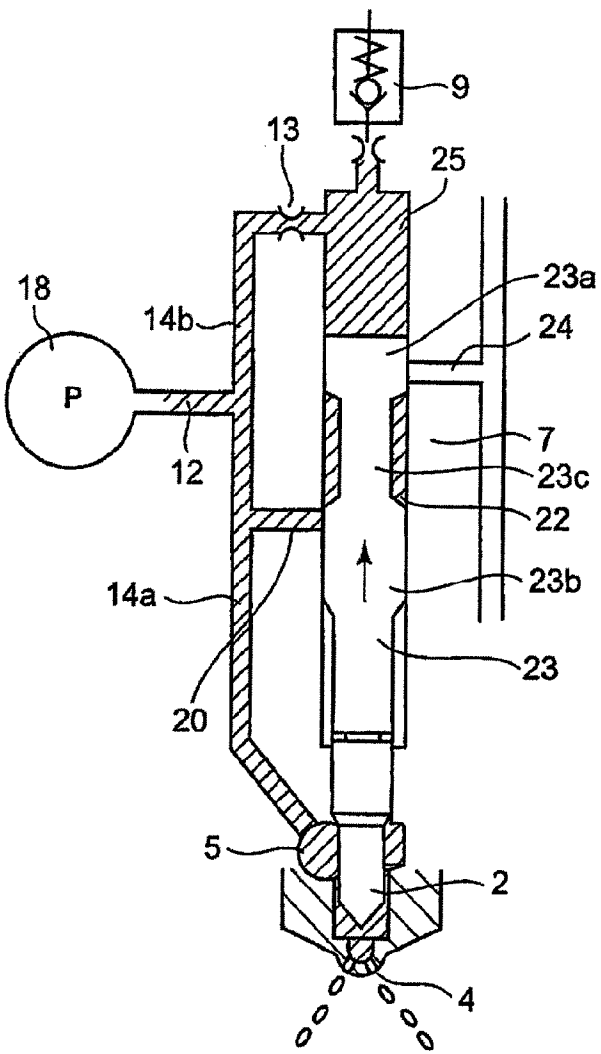
FIGS. 2, 2(A), 2(B) and 2(C) explain a second condition as to the fuel injection valve of the accumulator injection system (a common-rail injection system) according to the embodiment of the present invention, whereby, the second condition means a stage in which the fuel injection valve has begun to open and the lift is in a middle level.
Figure 2A:
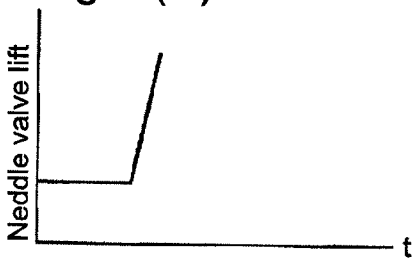
Figure 2B:
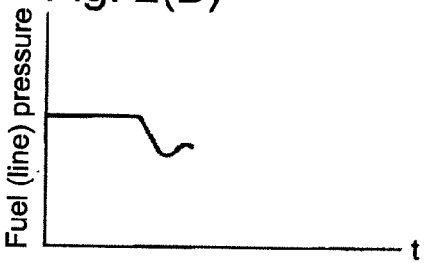
Figure 2C:
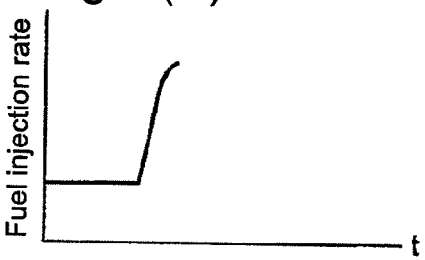

As shown in FIGS. 2, 2(A), 2(B) and 2(C), in the second stage where the fuel injection valve begins to open, namely, when the nozzle needle begins to be lifted up, the control rod is going to move upward, and the communication between the groove 22 and the fuel inlet passage 20 is shut (the control port is blocked); further, the fuel drain line 24 (the drain port) is blocked by a first outer diameter part 23*a* of the control rod 23. Thus, the nozzle needle 2 is somewhat lifted up away from the valve seat 5*a*, namely, the needle is in a partially lifted-up state. FIGS. 2(A), 2(B) and 2(C) show the lift of the nozzle needle, the pressure transition in the fuel lines 12, 14*a* and 14*b*, and the fuel injection rate in this second stage, respectively.

Figure 3:
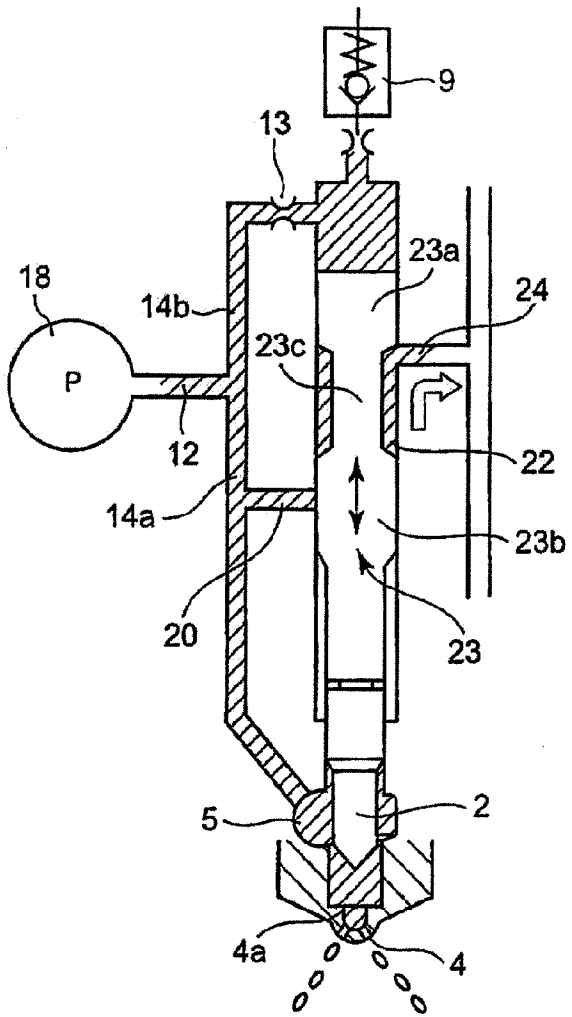
FIGS. 3, 3(A), 3(B) and 3(C) explain a third condition as to the fuel injection valve of the accumulator injection system (a common-rail injection system) according to the embodiment of the present invention, whereby, the third condition means a stage in which the fuel injection valve is fully opened, namely the nozzle needle is fully lifted up.
Figure 3A:
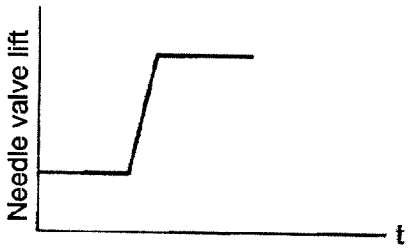
Figure 3B:
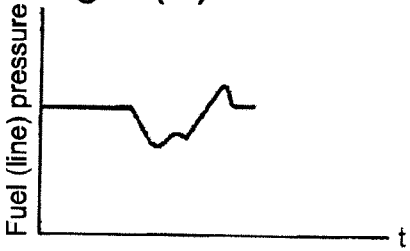
Figure 3C:
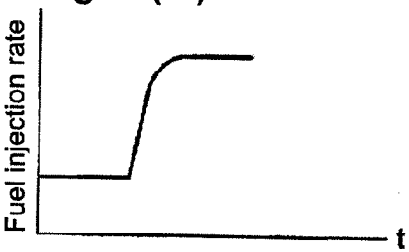

As shown in FIGS. 3, 3(A), 3(B) and 3(C), in the third stage where the fuel injection valve is fully opened, namely the nozzle needle is fully lifted up, the groove 22 communicates with the fuel drain line 24, and the fuel (or the pressure thereof) in the groove 22 is released toward the fuel drain line 24; thereby, the high pressure in the groove 22 is sufficiently reduced to the pressure level of the fuel drain line 24; in this circumstance, the communication between the groove 22 and the fuel inlet passage is being shut (the control port is being blocked); thus, the nozzle needle 2 is further lifted up away from the valve seat 5*a*, in comparison with the third state; namely, the lift is in a fully lifted-up state. The fuel injection toward the inside of the combustion chamber through the nozzle hole 4 of the nozzle 1 is performed in this third stage. FIGS. 3(A), 3(B) and 3(C) show the lift of the nozzle needle, the pressure transition in the fuel lines 12, 14*a* and 14*b*, and the fuel injection rate in this third stage, respectively.

As shown in FIGS. 4, 4(A), 4(B) and 4(C), in the fourth stage where the fuel injection valve has completed a fuel injection shot, the groove 22 is configured so as to communicate with the fuel inlet passage 20.

As described above, when the nozzle needle is fully lifted up, the fuel pressure in the groove 22 is reduced; subsequently, when the fuel injection shot is about to finish, the nozzle needle valve 2 is going to close under a condition that the groove 22 is filled with the fuel of a sufficiently reduced pressure.

Figure 4:
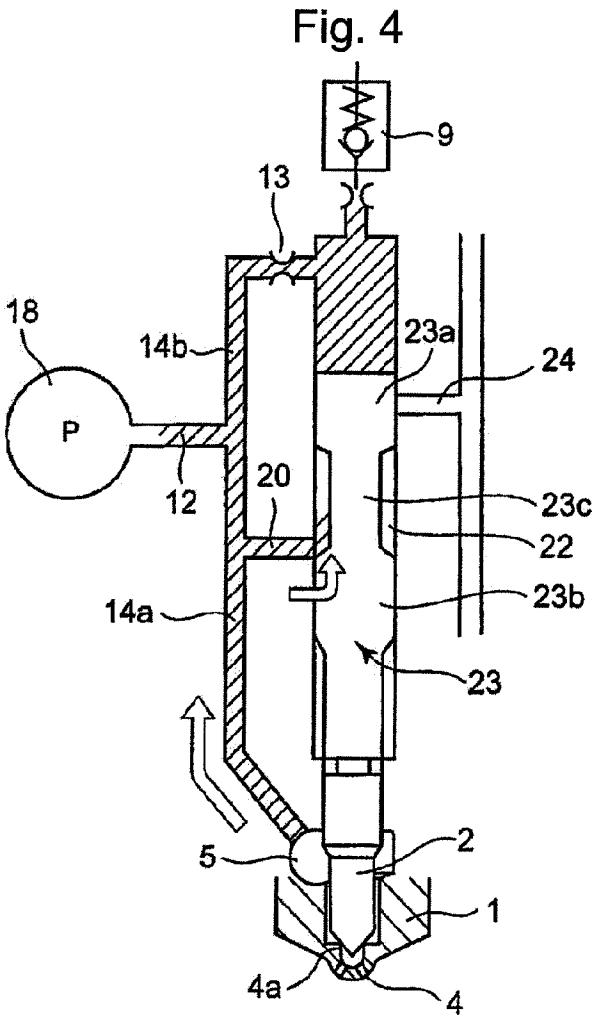
FIGS. 4, 4(A), 4(B) and 4(C) explain a fourth condition as to the fuel injection valve of the accumulator injection system (a common-rail injection system) according to the embodiment of the present invention, whereby, the fourth condition means a stage in which the fuel injection valve has completed a fuel injection shot.
Figure 4A:
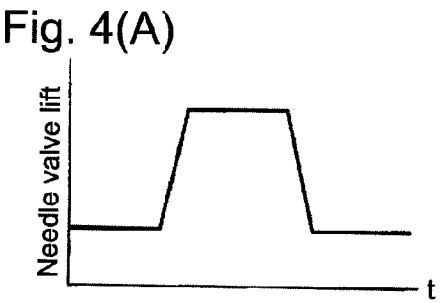
Figure 4B:
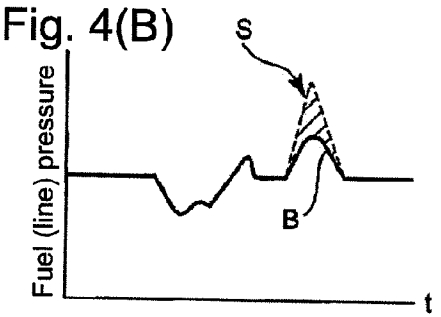
Figure 4C:
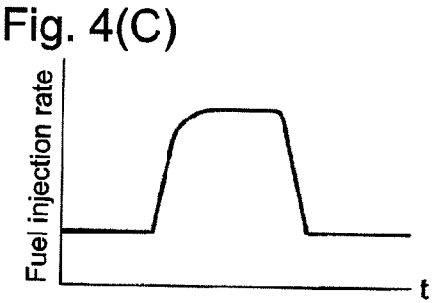

The surge pressure S (FIG. 4(B)) is generated, when the nozzle needle comes closer to the valve seat 4*a* (FIGS. 3 and 4) so as to sit thereon; at the same time, the port (the control port), namely, the fuel inlet passage 20 communicates with the groove 22 opens; thus, a part of the fuel flows into the groove 22, or a part of the high fuel pressure in the fuel inlet passage 20 is released toward the groove 22; therefore, the surge pressure in closing the nozzle needle valve 2 is restrained as the surge pressure curve S is controlled to a pressure curve B in FIG. 4(B).

Thanks to the above-described restraint of the surge pressure S, the deterioration as to the fuel injection performance or the strength of the injection valve components is prevented. The larger the capacity of the fuel injection valve that is installed in an engine, the more remarkable the surge pressure reduction.

Further, as described, in the case where the fuel injection process proceeds to the injection finish, the fuel injection valve is configured so that the groove 22 communicates with the fuel inlet passage 20 after the groove 20 has communicated with the fuel drain line 24 and the pressure in the groove has been sufficiently reduced; namely, before the communication between the groove 22 and the fuel inlet passage 20 is shut and the fuel injection starts, the groove 22 communicates with the fuel drain line 24 and the pressure in the groove 22 has been released; after all, in closing the nozzle needle valve, the port that connects the groove 22 to the fuel inlet passage 20 is smoothly opened (e.g., without a backward flow) under an condition that the pressure in the groove 22 is kept at a sufficiently reduced level. Accordingly, the effect as to the surge pressure attenuation can be enhanced.

INDUSTRIAL APPLICABILITY

The present provides a fuel injection valve of the accumulator injection system, whereby the surge pressure generated in closing the nozzle needle valve when the nozzle needle is going to sit on the valve seat is reduced; the deterioration as to the fuel injection performance and the strength of the injection valve components the deterioration which is caused by the surge pressures is prevented.

The invention claimed is:

1. A fuel injection valve for an accumulator injection system having a pressurized fuel accumulator and a combustion chamber, the fuel injection valve comprising:

a nozzle having a valve seat, a nozzle hole, and an inner space;

a nozzle needle disposed in the inner space of the nozzle and reciprocally slidable in the inner space of the nozzle;

a fuel passage for conveying fuel from the fuel accumulator to the nozzle hole;

a control rod having a groove; and a fuel drain line, wherein the nozzle and the nozzle needle are configured such that lifting the nozzle needle from the valve seat injects the fuel through the nozzle hole, wherein the control rod is configured such that the groove communicates with the fuel passage prior to a fuel injection shot, the groove is disconnected from the fuel passage and the fuel is injected through the nozzle hole during the fuel injection shot, and the groove communicates with the fuel passage at the end of the fuel injection shot, wherein the fuel passage comprises a first port, a second port, and a control port, the first port being configured such that the pressure of the fuel acts on the nozzle needle upward so as to open the nozzle, the second port being configured such that the pressure of the fuel acts on the control rod and the nozzle needle downward so as to close the nozzle needle valve, and the control port being configured such that the pressure of the fuel acts on the control rod and the groove and releases the pressure of the fuel in response to lifting the nozzle needle, and wherein the fuel drain line and the groove are configured such that lifting the control rod brings the groove into communication with the fuel drain line while the groove is disconnected from the fuel passage during the fuel injection shot such that the pressure in the groove is reduced to the drain line pressure level, and the groove comes into communication with the fuel passage again as the control rod is lowered after the pressure in the groove is reduced.

2. A fuel injection valve for an accumulator injection system having a pressurized fuel accumulator and a combustion chamber, the fuel injection valve comprising:

a nozzle having a valve seat, a nozzle hole, and an inner space;

a nozzle needle disposed in the inner space of the nozzle and reciprocally slidable in the inner space of the nozzle;

a fuel passage for conveying fuel from the fuel accumulator to the nozzle hole; and a control rod having a groove, wherein the nozzle and the nozzle needle are configured such that lifting the nozzle needle from the valve seat injects the fuel through the nozzle hole, wherein the control rod is configured such that the groove communicates with the fuel passage prior to a fuel injection shot, the groove is disconnected from the fuel passage and the fuel is injected through the nozzle hole during the fuel injection shot, and the groove communicates with the fuel passage at the end of the fuel injection shot, and wherein the fuel passage comprises a first port, a second port, and a control port, the first port being configured such that the pressure of the fuel acts on the nozzle needle upward so as to open the nozzle, the second port being configured such that the pressure of the fuel acts on the control rod and the nozzle needle downward so as to close the nozzle needle valve, and the control port being configured such that the pressure of the fuel acts on the control rod and the groove and releases the pressure of the fuel in response to lifting the nozzle needle.

3. A fuel injection valve for an accumulator injection system having a pressurized fuel accumulator and a combustion chamber, the fuel injection valve comprising:

a nozzle having a valve seat, a nozzle hole, and an inner space;

a nozzle needle disposed in the inner space of the nozzle and reciprocally slidable in the inner space of the nozzle;

a fuel passage for conveying fuel from the fuel accumulator to the nozzle hole;

a control rod having a groove; and a fuel drain line, wherein the nozzle and the nozzle needle are configured such that lifting the nozzle needle from the valve seat injects the fuel through the nozzle hole, wherein the control rod is configured such that the groove communicates with the fuel passage prior to a fuel injection shot, the groove is disconnected from the fuel passage and the fuel is injected through the nozzle hole during the fuel injection shot, and the groove communicates with the fuel passage at the end of the fuel injection shot, wherein the fuel passage comprises a first port, a second port, and a control port, the first port being configured such that the pressure of the fuel acts on the nozzle needle upward so as to open the nozzle, the second port being configured such that the pressure of the fuel acts on the control rod and the nozzle needle downward so as to close the nozzle needle valve, and the control port being configured such that the pressure of the fuel acts on the control rod and the groove and releases the pressure of the fuel in response to lifting the nozzle needle, and wherein the fuel drain line and the groove are configured such that lifting the control rod brings the groove into communication with the fuel drain line while the groove is disconnected from the fuel passage during the fuel injection shot such that the pressure in the groove is reduced.

* * * * *